United States Patent [19]

Mandel

[11] Patent Number: 4,877,234

[45] Date of Patent: Oct. 31, 1989

[54] SHEET TURNING AND REGISTRATION SYSTEM

[75] Inventor: Barry P. Mandel, Fairport, N.Y.

[73] Assignee: Xerox Corporation, Stamford, Conn.

[21] Appl. No.: 227,381

[22] Filed: Aug. 2, 1988

[51] Int. Cl.[4] ..... B65H 7/02

[52] U.S. Cl. ..... 271/225; 271/227; 271/250; 271/184

[58] Field of Search ..... 271/227, 248, 250, 251, 271/225, 184, 185

[56] References Cited

U.S. PATENT DOCUMENTS

| | | | |
|---|---|---|---|
| 2,190,413 | 2/1940 | Davidson | 271/49 |
| 2,190,416 | 2/1940 | Davidson | 271/49 |
| 2,243,557 | 5/1941 | Finster | 271/52 |
| 3,741,357 | 6/1973 | Krysiuk | 271/227 X |
| 4,052,054 | 10/1977 | Cardwell | 271/227 |
| 4,445,679 | 5/1984 | Bay | 271/227 |
| 4,456,116 | 6/1984 | Jarman | 198/414 |
| 4,482,147 | 11/1984 | Hibi | 271/185 X |
| 4,500,086 | 2/1985 | Garavuso | 271/225 |
| 4,511,242 | 4/1985 | Ashbee | 271/227 X |
| 4,669,719 | 6/1987 | Fratangelo | 271/251 |
| 4,733,857 | 3/1988 | Feldeisen | 271/225 X |

FOREIGN PATENT DOCUMENTS 1103356 3/1961 Fed. Rep. of Germany .

*Primary Examiner*—Richard A. Schacher
*Attorney, Agent, or Firm*—William A. Henry, II

[57] ABSTRACT

A copy sheet rotator in which a sheet is moved by two separately driven crowned rolls that form nips with cooperating idler rolls. For sheet turning, one roll is stopped with the sheet in the nip while the other roll continues to drive and rotate the sheet. A separate scuffer roller registers the rotated sheet after it has been released from the rolls without scuffing damage. The position, angle and velocity of the scuffer allows the sheet to remain in tension during rotation and therefore prevents buckling without the need for nip release systems.

7 Claims, 3 Drawing Sheets

SHEET TURNING AND REGISTRATION SYSTEM

This invention is directed to positioning sheets before they reach a sheet folding apparatus, and more particularly, to a sheet turning and registration system used with such an apparatus.

In order to preform standard letter folds using a buckle folder, sheets must be fed to the folder short edge first. Since the output from most copiers and electronic printers is long edge first, some type of sheet turning mechanism is necessary if folding is to be done in an on-line, straight-line system. If a right angle sheet transport system is used, everything is turned, and it is no longer possible to use the same folder to fold A3 or other size sheets that are often already oriented short edge first.

Systems in the past have been able to rotate materials for different reasons by the use of costly, cumbersome and complicated mechanisms and devices. For example, U.S. Pat. Nos. 2,190,413 and 2,190,416 show a ball-on-belt transport that provides 90 degree rotation of paper in a folding machine. A ball track is included that appears to be primarily a guide, with the actual rotation of a paper being caused by a shoulder which the paper strikes as it moves along the belt of the transport system. In U.S. Pat. No. 4,445,116 front feed equipment for facilitation the feeding of sheet metal into the cutting area of shear equipment is shown that teaches rotating a piece of metal by selectively adjusting the pressure applied between a plurality of rollers and balls. German Patent No. 1,103,356 is directed to a device for aconveying and at the same time aligning individual sheets along an aligning guide using a conveyor belt which is inclined slightly with respect to the direction of paper travel and has a number of feeding moving spheres in cages. In U.S. Pat. No. 2,243,557, a device for rotating sheets of paper through a given angle is disclosed. One forward corner of a sheet engages with a ball 34 while momentum and gravity causes the sheet to rotate about the ball. Continued movement of the sheet is preferably supplemented by a flipping action of a fin 26 which imparts further turning movement about the ball. An apparatus for transpoorting and rotating sheeets of different rectangular dimensions is shown in U.S. Pat. No. 4,445,679. A holder device 17 holds the sheets in a manner to create an axis of rotation. This sheet is then pivoted by ninety degrees under the influence of a longitudinal transporting means. A rotating inverter is disclosed in U.S. Pat. No. 4,500,086 that includes primary rollers and secondary rollers. The secondary rollers rotate in the direction opposite to the incoming sheet and opposite to the primary rollers to cause the sheet to be rotated. U.S. Pat. No. 4,669,719 shows a sheet rotation and registration vertical transport wherein balls selectively retard one side of the sheet moving along a conveyor to cause the sheet to rotate due to the pull of gravity against the sheet. The heretofore mentioned sheet transport systems do not appear to be adaptable to the rotation of sheets in copiers in some instances and in most instances are bulky, complicated and costly.

Accordingly, a sheet rotator is disclosed that is valuable for feeding into short edge feed finishers from long edge feed machines and includes apparatus for moving a sheet by two separately driven crowned rolls. For turning, one roll is stopped with the sheet in the nip while the other roll continues to drive and rotates the sheet. A separate scuffer registers the rotated sheet after it has been released from the rolls. The position, angle and velocity of the scuffer roll relative to the crowned rolls allows the sheet to remain in tension during rotation, thereby preventing paper buckling without the need for nip releases. The sheet rotates about a point under the stopped crowned roll without scuffing damage.

The above-mentioned features and others of the invention, together with the manner of obtaining them, will best be understood by making reference to the following specification in conjunction with the accompanying drawings, wherein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is had to the drawings.

The sheet turning and registration apparatus of the present invention comprises two pairs of crowned roll nip rollers. Turning of a sheet is accomplished by stopping one set of the rolls with a clutch/brake while the other roll set continues to drive. The sheet then pivots about the stopped rolls until it has been turned 90 degrees. At that time, the stopped roll pair is reengaged. The problem of where to place the next nip in view of the fact that the sheet is turning in front of the crowned roll pair during rotation is solved by locating a skewed scuffer roll (or other type of registration roll) in such a location that it has a velocity component in the direction of sheet motion sufficient to keep the sheet in tension during turning. After the turn is completed, the scuffer slips on the sheet until the sheet leaves the two crowned roll nips. It then side registers the sheet against a registration edge. Registration of the sheet is an important and necessary function since there is inherent variation in the 90 degree turn performed in the crowned rolls due to variations in roller speed and clutch actuation time.

Figure 1:
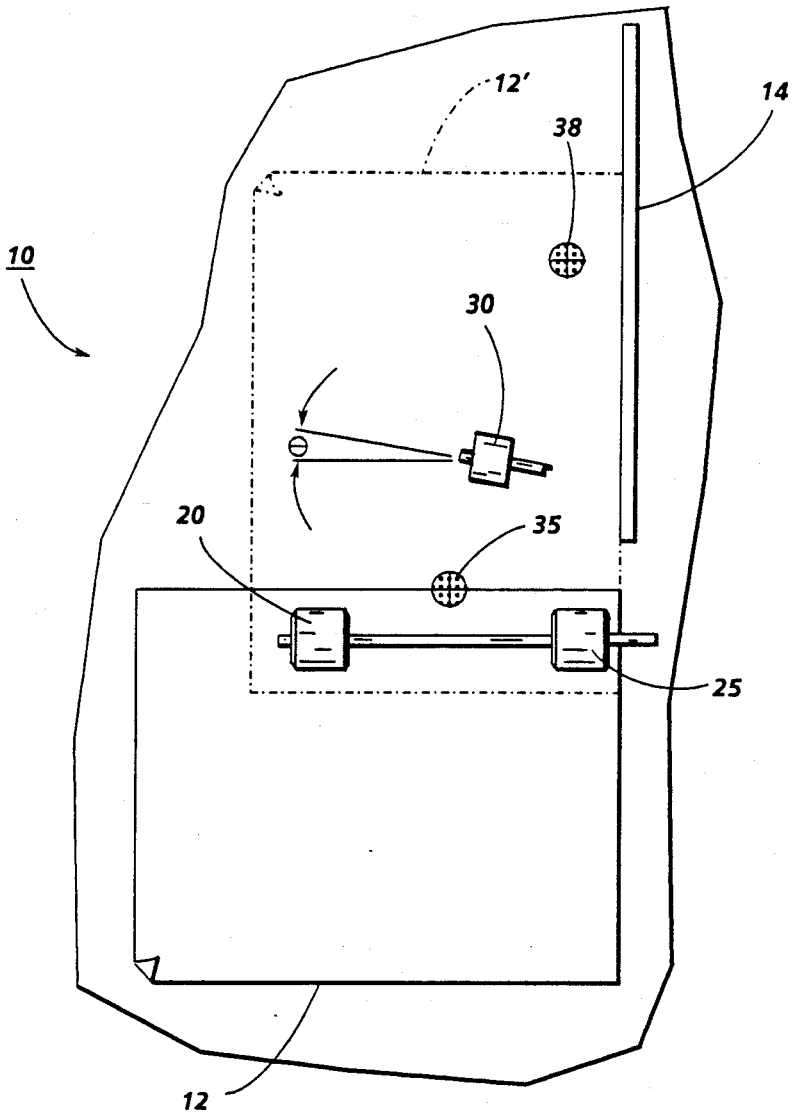
FIG. 1 is a schematic plan view showing the sheet turning and registration apparatus of the present invention.
Figure 2:
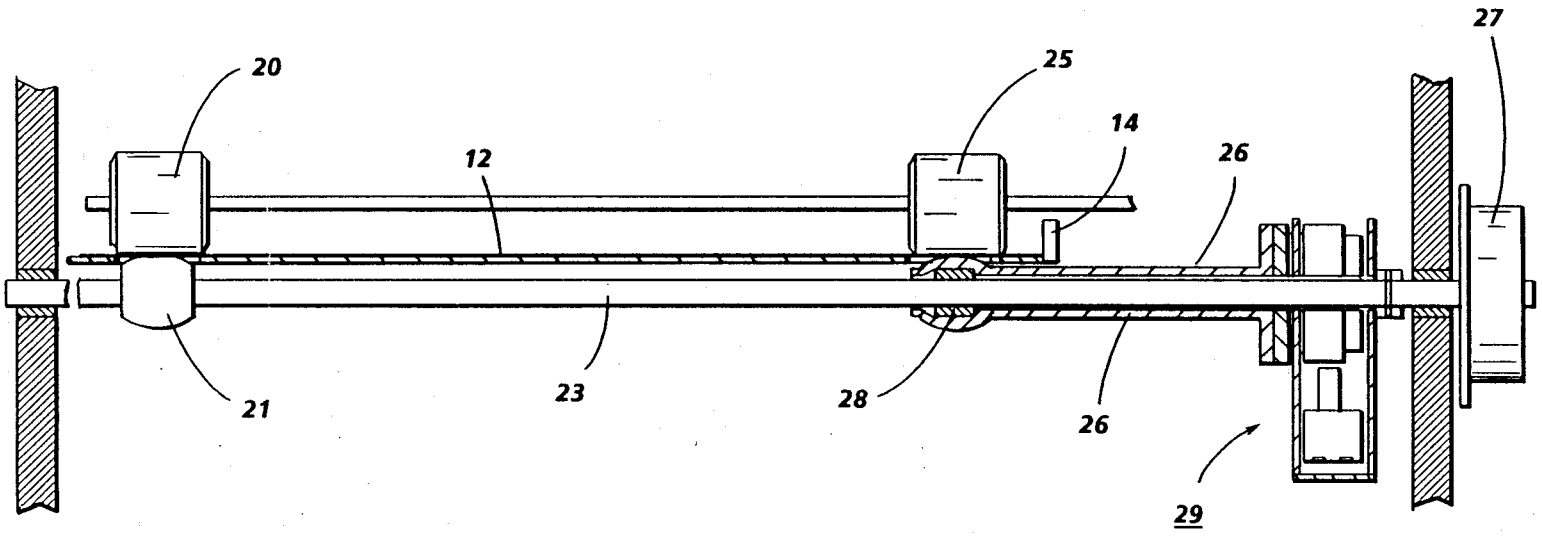
FIG. 2 is an end elevational view of the sheet turning and registration apparatus of FIG. 1.
Figure 3:
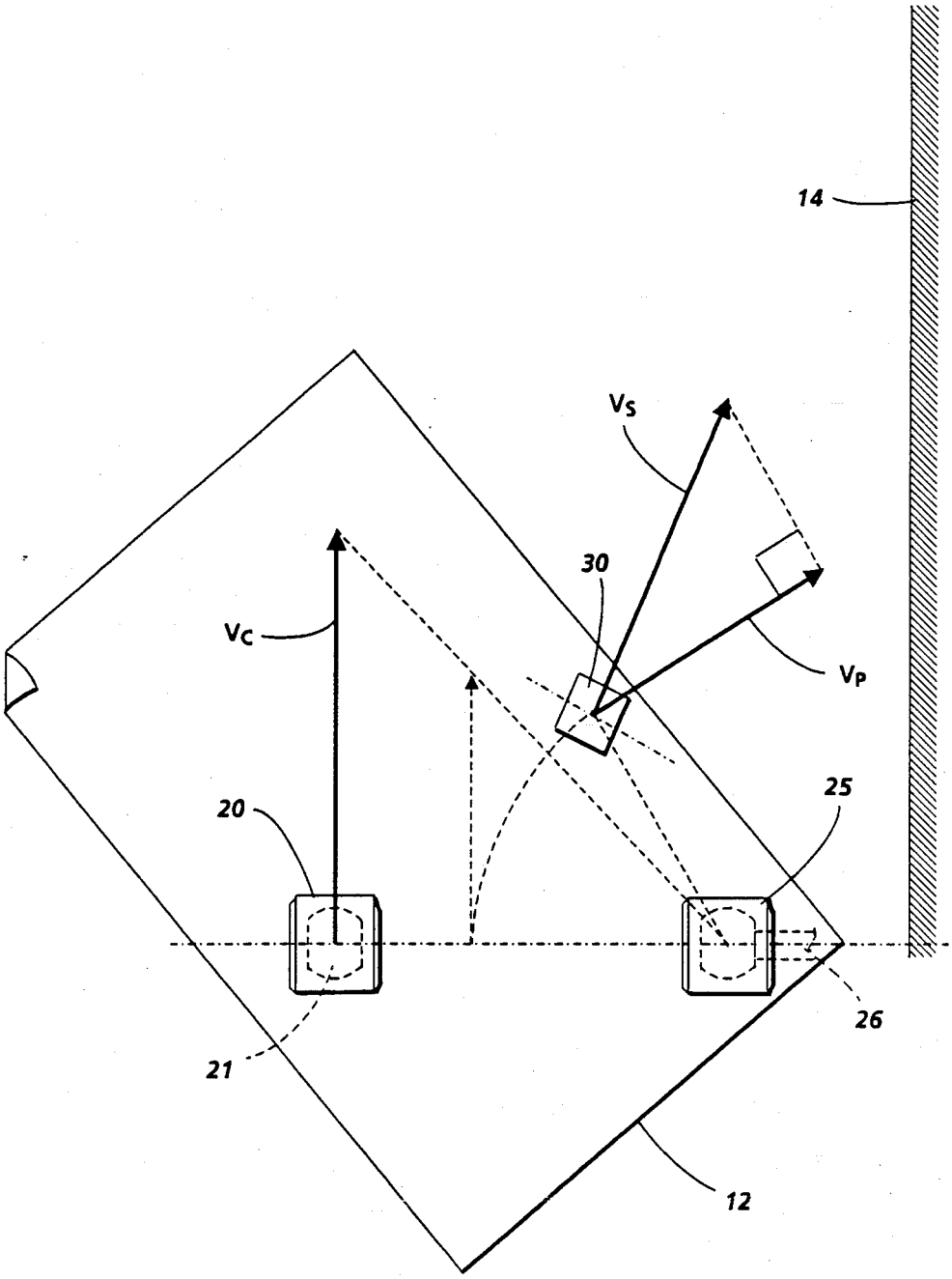
FIG. 3 is a diagram showing the required velocity vector of the scuffer used in the present invention to prevent sheet buckling during rotation.

With particular reference to FIGS. 1 and 2, The sheet turning and registration system 10 employs idler rolls 20 and 25 that are mounted matingly with driven crowned roller 21 and driven extension member 26 having a crowned end portion. The system is adapted to either turn and then register sheets, or to pass them unturned and just register them. Thus, the system is ideal for use before a folder where some, but not all sheets require turning. As shown in FIGS. 1 and 2, a sheet 12 enters the crowned roll nips in a portrait orientation and after a short distance of transport by drive members 26 and 21 by way of drive input 27 it blocks a sensor 35 and the nip formed between members 25 and 26 mounted on bearings 28 is stopped by the use of clutch/brake mechanism 29, for example, of the type made by Warner Electric as (Model SP-2, single revolution type with over-travel stop shaft input, hub output, and 24 stop hub). Rollers 20 and 21 continue to rotate which causes the sheet to pivot about the nip that has stopped rotating. The sheet can spin about the stopped nip for either a specified time or until it blocks a sensor 38 which gives off a signal that the sheet is near registration edge or wall 14. Another alternative would be to position sensor 35 before the crowned roll nips and use it to sense both the lead edge of an incoming sheet and the trail edge of a sheet after rotation. At this time, the stopped roller pair is re-engaged so that the rollers revolve at the same speed as the continuously driven roller pair. When the sheet leaves the crowned roller nips, it is registered in a landscape position by a scuffer roll 30 that is positioned at an angle $\theta$ with respect to a vertical plane and turning at a speed such that the sheet is kept in tension during turning (as shown in FIG. 3), sufficient side registration is provided to the sheet and the sheet is transported along the registration edge and delivered to the next nip at a paper speed within the desired range. A completely turned sheet is shown as 12' in FIG. 1. For straight through operation, both crowned roller pairs are left ON continuously.

A diagram is shown in FIG. 3, of the velocity vector of the scuffer roll 30 that is required in order for the the crown roll and sheet turning mechanism to turn sheets without buckling during sheet rotation. The location, angle and speed of scuffer roll 30 must be determined such that the following three criteria are satisfied: (1) The sheet is kept in tension during turning; (2) Sufficient side registration is provided, given the tolerances of the turn mechanism; and (3) Sheets are transported along the registrattion edge and delivered to the next nip at at paper speed within the desired range. In the diagram of FIG. 3, $V_s$ is the required vector to prevent buckling, $V_p$ is the paper vector and $V_c$ is the crown roll vector.

It should now be understood that a device has been disclosed that is used to accurately turn sheets 90 degrees from their original orientation and can operate at high copy rates. The device employs a pair of crowned roller nips with one of the nips being clutch controlled to stop a sheet in the clutched nip in order to turn the sheet with the other nip that is continuously driven. The clutch is actuated when a sensor is blocked by a sheet driven by both nips and de-actuated when the sheet has been turned 90 degrees thereby allowing the sheet to be transported forward to the next nip by both sets of roller nips.

What is claimed is:

1. A sheet turning mechanism having the capability of turning sheets 90 degrees and registering them against a registration member or passing them unturned but registered is adapted for use with a folder apparatus and characterized by at least one pair of crowned rollers that form nips with cooperating idler rollers; sensor means adapted to provide a signal when blocked by a sheet to a clutch mechanism that stops one of said at least one of said pair of crowned rollers with the other of said at least one pair crowned of rollers continuing to revolve and thereby rotate each sheet 90 degrees; means for re-energizing said stopped crowned roller after each sheet has finished rotating; and scuffer means for registering each sheet after it leaves said at least one crowned roller pair.

2. The sheet turning mechanism of claim 1, wherein said scuffer means is angled with respect to a vertical plane.

3. The sheet turning mechanism of claim 2, wherein said means for re-energizing said stopped crowned roller after each sheet has finished rotating is a sensor.

4. The of sheet turning mechanism claim 3, wherein said scuffer means keeps the sheet in tension during rotation so as to prevent buckling.

5. A sheet turning mechanism having the capability of turning sheets 90 degrees and registering them against a registration member or passing them unturned but registered without the use of nip release systems is characterized by at least pair of crowned rollers that form separate nips with idler rollers; sensor means adapted to provide a signal when blocked by a sheet to a clutch mechanism that stops one of said at least one pair of crowned rollers with the other of said at least one pair of crowned rollers continuing to revolve and thereby rotate each sheet 90 degrees; means for re-energizing said stopped crowned roller after each sheet had finished rotating; and scuffer means for registering each sheet after it leaves said at last one crowned roller pair, said scuffer means being positioned and driven at an appropriate speed relative to said at least one pair of crowned rolls such that the sheet is kept in tension during rotation, thereby preventing buckling.

6. The sheet turning mechanism of claim 5, wherein said scuffer means is angled with respect to a vertical plane.

7. The sheet turning mechanism of claim 6, wherein said means for re-energizing said stopped crowned roller after each sheet has finished rotating is a sensor.

* * * * *